US008262281B2

(12) United States Patent
Van Den Bijgaart et al.

(10) Patent No.: US 8,262,281 B2
(45) Date of Patent: Sep. 11, 2012

(54) DEVICE FOR MIXING A LIQUID MEDIUM

(75) Inventors: Adrianus Wilhelmus Dionisius Maria Van Den Bijgaart, Eindhoven (NL); Ronald Cornelis De Gier, Eindhoven (NL); Sergei Shulepov, Eindhoven (NL); Chris Van Haag, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1296 days.

(21) Appl. No.: 11/917,953

(22) PCT Filed: Jun. 19, 2006

(86) PCT No.: PCT/IB2006/051958

§ 371 (c)(1),
(2), (4) Date: Dec. 18, 2007

(87) PCT Pub. No.: WO2006/136999

PCT Pub. Date: Dec. 28, 2006

(65) Prior Publication Data

US 2010/0039887 A1 Feb. 18, 2010

(30) Foreign Application Priority Data

Jun. 23, 2005 (EP) ..... 05105601

(51) Int. Cl.
*B01F 11/00* (2006.01)

(52) U.S. Cl. ..... 366/275

(58) Field of Classification Search ..... 366/275, 366/277; 417/437

See application file for complete search history.

(56) References Cited

U.S. PATENT DOCUMENTS

| | | | | |
|---|---|---|---|---|
| 2,152,455 | A * | 3/1939 | Ballentine | 366/275 |
| 2,265,516 | A * | 12/1941 | Chayie | 68/21 |
| 3,097,366 | A * | 7/1963 | Winchell | 623/3.17 |
| 3,132,848 | A * | 5/1964 | Garlinghouse | 366/45 |
| 3,313,240 | A * | 4/1967 | Bentov | 137/3 |
| 3,744,277 | A * | 7/1973 | Grantham | 68/53 |
| 3,765,127 | A * | 10/1973 | Garlinghouse | 451/326 |
| 3,833,203 | A * | 9/1974 | Garlinghouse | 366/113 |
| 3,947,156 | A * | 3/1976 | Becker | 417/437 |
| 3,962,892 | A * | 6/1976 | Garlinghouse | 68/23 R |
| 4,072,030 | A * | 2/1978 | Garlinghouse | 68/23 R |
| 4,095,288 | A * | 6/1978 | Garlinghouse | 366/219 |
| 4,112,518 | A * | 9/1978 | Garlinghouse | 366/219 |
| 5,006,104 | A * | 4/1991 | Smith et al. | 600/16 |
| 5,193,977 | A * | 3/1993 | Dame | 415/206 |
| 6,416,212 | B1 * | 7/2002 | Rogers et al. | 366/117 |
| 6,494,613 | B2 * | 12/2002 | Terentiev | 366/279 |
| 6,634,783 | B2 * | 10/2003 | Baron | 366/204 |
| 7,249,880 | B2 * | 7/2007 | Zambaux | 366/277 |

(Continued)

FOREIGN PATENT DOCUMENTS

EP 1161294 B1 12/2001

(Continued)

*Primary Examiner* — Tony G Soohoo

(57) ABSTRACT

The invention provides a device for mixing a liquid medium, an apparatus for mixing a liquid medium, a system comprising a device and an apparatus and a method for mixing a liquid medium. The device comprises a flexible membrane (12) and a structural part (16), which device further comprises an actuation part (14) located on a first side of the membrane, which device further comprises a mixing chamber (20) located on a second side of the membrane, wherein at least a partial inclination of the membrane results from an inclination of the actuation part relative to the structural part.

20 Claims, 2 Drawing Sheets

U.S. PATENT DOCUMENTS

| | | | | |
|---|---|---|---|---|
| 7,431,494 | B2 * | 10/2008 | Zambaux | 366/144 |
| 7,614,781 | B2 * | 11/2009 | Esveld et al. | 366/275 |
| 7,789,551 | B2 * | 9/2010 | Ray et al. | 366/108 |
| 2002/0105856 | A1 * | 8/2002 | Terentiev | 366/262 |
| 2003/0107946 | A1 | 6/2003 | Cosby et al. | |
| 2006/0140052 | A1 * | 6/2006 | Esveld et al. | 366/275 |
| 2007/0127309 | A1 * | 6/2007 | Nitta et al. | 366/114 |
| 2010/0039887 | A1 * | 2/2010 | Van Den Bijgaart et al. | 366/275 |

FOREIGN PATENT DOCUMENTS

| | | |
|---|---|---|
| FR | 2803225 | 7/2001 |
| GB | 1593122 | 7/1981 |
| WO | 02072264 A1 | 9/2002 |
| WO | 03015923 A1 | 2/2003 |

* cited by examiner

DEVICE FOR MIXING A LIQUID MEDIUM

The present invention relates to a device for mixing a liquid medium. The present invention further relates to an apparatus for mixing a liquid medium provided in a mixing chamber. The present invention further relates to a system for mixing a liquid medium, the system comprising an apparatus and a device. The present invention further relates to a method for mixing a liquid medium.

In the field of analysis of biological samples, especially molecular diagnostic as well as nucleic acid analysis, and in particular analysis by isolation of nucleic acid from biological or clinical specimen, there is a need for an enhanced degree of automation because, e.g. the isolation of nucleic acid from biological samples can be time-consuming and tedious. Sample preparation might include cell isolation, cell lysis and washing. For genetic analysis regarding genetic-based disease, conditions or characteristics, it is essential to have available a reliable, easily reproduced method of nucleic acid isolation, particularly one that is amenable to automation. This requirement is particularly useful for detection of specific bacterial DNA in low concentrations in a body fluid of a patient.

In this context, it is usually necessary to mix two or more fluids in a process-chamber. The Mixing is needed to get a homogeneous mixture out of multiple fluids. It is usually also necessary to perform a lysis-step of e.g. cells or other biological materials. Lysis is the process of breaking cell walls, e.g. to obtain free nucleic acids. For that reason, a quick and cost effective mixing possibility is necessary.

Devices for mixing a liquid medium are generally known. For example, European patent EP 1 161 294 B1 discloses an active micromixer comprising a membrane element, a substrate element and a mixing chamber. It has been realised that in prior art apparatuses for mixing a liquid medium, the mixing efficiency in relation to the costs and efforts for the structure of the mixing device on the one hand and for the actuation of the mixing devices on the other hand is unsatisfactory.

It is therefore an object of the present invention to provide a device for mixing a liquid medium whereby the device has a flexible way of actuation and whereby the device is cheap and simple to construct.

The above objective is accomplished by a device, an apparatus, a system and a method for mixing a liquid medium. The device for mixing a liquid medium comprises a flexible membrane and a structural part, which device further comprises an actuation part located on a first side of the membrane, which device further comprises a mixing chamber located on a second side of the membrane, wherein at least a partial inclination of the membrane results from an inclination of the actuation part relative to the structural part. The wording "liquid medium" according to the present invention is to be understood as comprising any type of liquid fluid, consisting either of one or a plurality of fluids, mixtures comprising at least a liquid fraction like an emulsion, a suspension or the like. The wording "inclination" according to the present invention means a certain angle at which the actuation part is inclined along a certain direction of inclination. The inclination of the actuation part provides at least a partial inclination of the membrane, i.e. at least one portion of the membrane is raised (with respect to the structural part) and at least another portion of the membrane is lowered (also with respect to the structural part).

An advantage of the device according to the invention is that it is possible to very easily mix a plurality of liquids or perform a lysis-step in the interior of a mixing chamber by means of simply inclining the actuation part from the exterior of the device, e.g. by an instrument or an apparatus provided with a corresponding actuation means. It is particularly advantageous that the device according to the invention is able to mix and/or do a lysis-step in several different ways, especially depending on the type of actuator that is used. By mixing fluids, a chaotic flow pattern exists within the fluid, which results in high shear forces or shear stresses. In addition, it is possible to also perform a lysis-step by means of the device of the present invention.

The device according to the present invention can be used as a part of an integrated system, e.g. a microfluidic system with a plurality of different components and inter alia a mixing chamber. Such an integrated system could be provided in the form of a disposable cartridge where inside the cartridge is performed a complete sequence of a microbiological detection or analysis assay. The device can also be used as a stand-alone unit.

According to the invention, it is possible to fully close the device so that no contamination of the liquids in the interior of the device or by the liquids in the interior of the device is possible.

A further advantage of the present invention is that it is possible to render the device very cost-effective, especially because only inexpensive materials like plastic materials, are needed to construct the device.

In a preferred embodiment of the present invention the membrane and the actuation part are provided as a one-piece part. This has the advantage that cost can be even more reduced for building the device of the present invention. Furthermore, this feature has the advantage to provide a very stable and lasting connection between the membrane and the actuation part, thereby enhancing the performance in terms of durability of the device according to the present invention. This further leads to potential cost reductions because the actuation part and/or the membrane can then be provided using less material.

In a further preferred embodiment of the present invention the membrane and the structural part are connected in an edge region of the membrane and/or the actuation part is provided in a center part of the membrane. It is then possible to provide a device with high performance mixing capabilities by only using low-cost materials, because this renders the membrane more flexible such that for a given inclination of the actuation part a higher amplitude of movement is achievable, thus leading to a better mixing.

In a further preferred embodiment of the present invention the device comprises a foil connected to the structural part, wherein the foil is located on the second side of the membrane and wherein the mixing chamber is located between the foil and the membrane, the foil being preferably a flexible foil. An advantage of the device according to the present invention is that it is possible to impose on the device even a greater degree of flexibility and thereby a greater degree of mixing efficiency by introducing the foil. A foil can be very easily connected to the membrane and/or to the structural part of the device so that the aim of isolating the medium or liquid inside the mixing chamber is very cost-effectively and easily protected from the outside (and the outside protected from the liquid inside the device).

In still a further preferred embodiment of the present invention the foil is provided such that a movement of the foil in a direction perpendicular to the membrane is at least partly prevented by the structural part when the mixing chamber is filled with the medium, the movement of the foil being preferably prevented in a center region opposite the center part of the membrane. It is thereby possible to limit the fluid-height inside the mixing chamber which further enhances the mixing efficiency.

The present invention also includes an apparatus for mixing a liquid medium provided in a mixing chamber, which apparatus comprises an actuation means provided to impose an inclination movement on an actuation part of an inventive device. By means of the inventive apparatus it is possible in a very easy and cost-effective manner to actuate a mixing device according to the present invention.

In a preferred embodiment of the present invention the apparatus comprises an adapter part capable of imposing the inclination movement on the actuation part, the adapter part being preferably provided as a ball-bearing. It is thereby possible to mechanically impose the movement of the actuation means of the apparatus on the actuation part of the device. Other configurations of actuator means and/or of adapter means are also possible, e.g. an electrical or magnetic actuator where the actuation part of the device is provided with a magnetic material so that the actuation part is inclined by means of magnetic forces.

In a preferred embodiment of the present invention the actuation means is provided as an eccentric and wherein the adapter part describes a rotational movement. It is thereby possible to use a simple rotational movement inside the apparatus to actuate the mixing device. The rotational movement can, e.g. be generated by an electrical motor where the eccentric is mounted, e.g. to the shaft of the motor. An advantage of a rotational movement of the top portion of the actuation part (taken along by the adapter part and/or the actuation means) is that the at least partial inclination of the membrane (i.e. the lowering of at least one portion of the membrane and the raising of at least another portion of the membrane) follows the rotational movement of the top portion of the actuation part in order to very efficiently mixing the fluid.

In a preferred embodiment of the present invention the eccentricity of the actuation means is made changeable. It is then possible, to change the inclination or angle of inclination and thereby to change the mixing force introduced into the device. It is then also possible to make the apparatus adaptable to different devices, e.g. differently sized devices.

The present invention also includes a system for mixing a liquid medium, which system comprises an apparatus and a device, which device comprises a flexible membrane and a structural part, which device further comprises an actuation part located on a first side of the membrane and a mixing chamber located on a second side of the membrane, wherein at least a partial inclination of the membrane results from an inclination of the actuation part relative to the structural part, wherein the apparatus comprises an actuation means provided to impose an inclination movement on the actuation part of the device. It is preferred that the mixing chamber is located inside a disposable cartridge which can be inserted or taken out of the apparatus by means of, e.g. a slot or the like. It is then possible for the medium inside the mixing chamber to be completely isolated from the apparatus and for the system to realize a closed system regarding the medium. Inside the cartridge, the mixing chamber is preferably linked to other compartments such as reaction chambers, reservoirs or the like. The mixing chamber communicates with these other compartments by means of an inlet and an outlet.

The present invention also includes a method for mixing a liquid medium by means of a device for mixing a liquid medium, which device comprises a flexible membrane and a structural part, which device further comprises an actuation part located on a first side of the membrane and a mixing chamber located on a second side of the membrane, which method comprises:

in a first step inclining the actuation part relative to the structural part by means of a first inclination movement and thereby inclining the membrane at least partially, in a second step inclining the actuation part relative to the structural part by means of a second inclination movement and thereby at least partially inclining the membrane differently. Thereby, the mixing efficiency can be greatly enhanced.

These and other characteristics, features and advantages of the present invention will become apparent from the following detailed description, taken in conjunction with the accompanying drawings, which illustrate, by way of example, the principles of the invention. The description is given for the sake of example only, without limiting the scope of the invention. The reference figures quoted below refer to the attached drawings.

Figure 1:
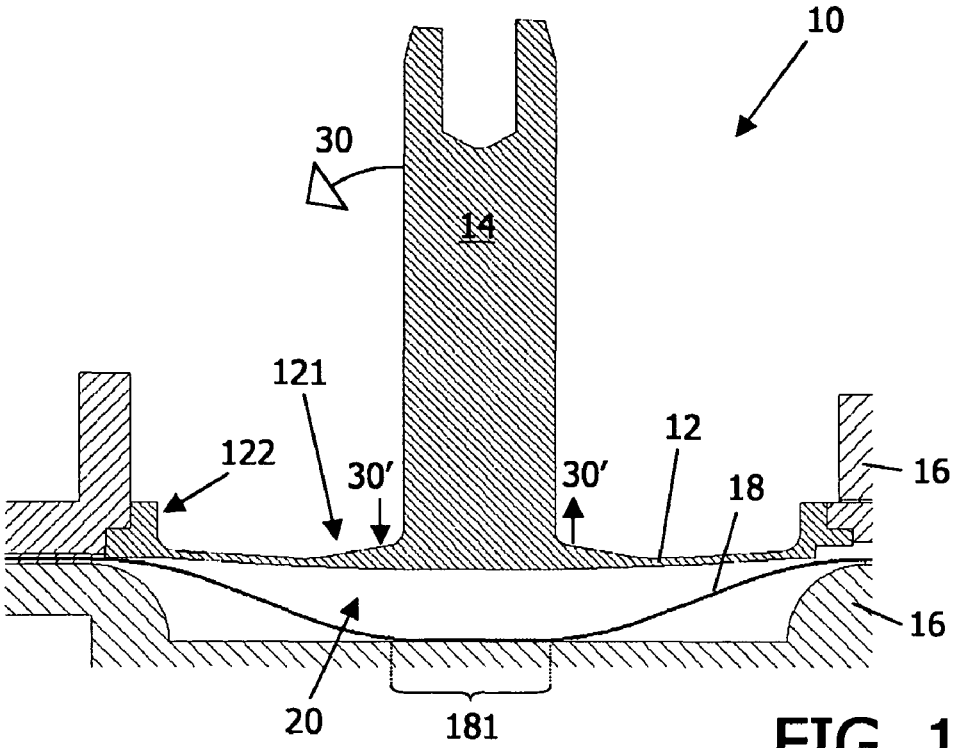
FIG. 1 illustrates schematically a device according to a first embodiment of the present invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn to scale for illustrative purposes.

Where an indefinite or definite article is used when referring to a singular noun, e.g. "a", "an", "the", this includes a plural of that noun unless something else is specifically stated.

Furthermore, the terms first, second, third and the like in the description and in the claims are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising", used in the present description and claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B.

Figure 2:
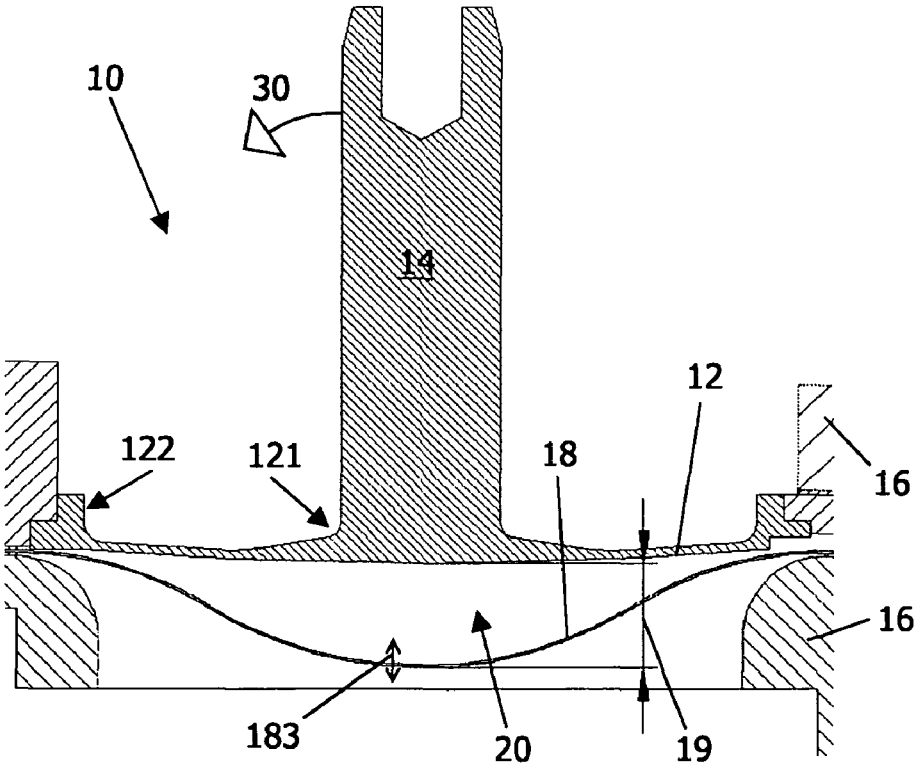
FIG. 2 illustrates schematically a device according to a second embodiment of the present invention.

In FIG. 1 a device 10 according to a first embodiment of the present invention is schematically illustrated. In FIG. 2 the device 10 according to a second embodiment of the present invention is schematically illustrated. In the following, FIG. 1 and FIG. 2 are described in common. The device 10 comprises a flexible membrane 12, an actuation part 14 and a structural part 16. The structural part 16 can be provided as a plurality of different parts. Preferably, the flexible membrane 12 and the actuation part 14 are formed as a one-piece part. In addition, it is possible for the mechanical forces applied to the actuation part 14 to be easily and effectively imposed on the membrane 12. For example, the one-piece part of the membrane 12 and the actuation part 14 can be provided as a result of pressure die-casting. According to the invention, the preferred materials can include thermoplastic materials, like polypropylene, that can combine the properties of sufficient mechanical strength, elastic deformation, and a high fatigue strength. Such materials are also used in e.g. hinges. In the example shown, the membrane 12 is fixed to the structural part 16 in an edge region 122 of the membrane 12, whereas the actuation part 14 is formed in a center region 121 of the membrane 12. The side of the membrane 12 where the actuation part 14 is located is also called the first side of the membrane 12. On the opposite side of the membrane 12, which is hereinafter called the second side of the membrane 12, is located a foil 18 associated to the membrane 12 and to the structural part 16 or to only fixed to the membrane 12. The foil is made of a flexible material, e.g. a web or film material. A mixing chamber 20 is defined by a cavity between the membrane 12 and the foil 18. In use, the mixing chamber 20 is filled with a liquid or medium (not shown) or with a plurality of liquids or with a plurality of liquids together with particles such as cells, bacteria or the like. The structural part 16 can advantageously be provided by an upper part 16*a* and a bottom part 16*b*. Preferably, the membrane 12 and the foil 18 are fixed to the upper part 16*a* in a fluid-tight manner and the bottom part 16*b* is joined for mechanical stability of the device 10.

The structural part 16 can be provided such that a movement of the foil 18 is at least partially limited by the structural part 16. This is the case with the first embodiment shown in FIG. 1. There, in a central region 181 of the foil 18, the structural part 16 abuts against the filled foil 18 (or vice versa) limiting a movement of the foil in a direction perpendicular to the membrane 12. The opposite is the case in a second embodiment shown in FIG. 2. There, even in the central region 181 (not shown in FIG. 2) of the foil 18, the foil is able to effect a movement 183 in a direction perpendicular to the membrane 12. In the first embodiment of the device, the height of the medium in a direction perpendicular to the membrane is defined by the structural part 16. In the second embodiment of the device, the height 19 of the medium or of the liquid in this direction perpendicular to the membrane is defined only by the foil 18.

In both embodiments of the device, it is possible to have a different situation of the liquid in the mixing chamber 20, e.g. a different pressure situation, leading to a movement of the foil 18 in regions of the foil 18 where the movement of the foil is not limited by the structural part 16. For example, this is the case in FIG. 1 between the center region 181 of the foil 18 and the edge region of the foil (not shown with a separate reference sign but located opposite the edge region of the membrane 12).

According to the invention, the device 10 is provided such that the liquid or the medium can be inserted or introduced into the mixing chamber 20 by means of an inlet (not shown in FIGS. 1 and 2). Accordingly, the device 10 also comprises an outlet (not shown in FIGS. 1 and 2) for pushing out the liquid inside the mixing chamber 20. When the liquid enters the mixing chamber 20, the foil 18 is preferably deformed. In another embodiment of the invention, it is also possible to choose the foil to be more rigid such that deformation is more or less inhibited. In another such embodiment, the foil 18 could also be omitted and only the structural part 16 could serve as a counterpart of the membrane 12 for defining the cavity of the mixing chamber 20. In the following, these embodiment will not be described further because it is preferred to provide the mixing device with a foil 18.

The mixing process inside the mixing chamber 20 of the device 10 is initiated by inclining the actuation part 14 of the device 10 by an inclination denoted by reference sign 30 in FIGS. 1 and 2. In this example of an inclination 30 a mechanical force acts on the actuation part 14 in a direction parallel or almost parallel to the membrane 12 and at a certain distance from the membrane 12, thereby imparting a torque on the membrane 12. The membrane 12 is fixed in its edge region 122 and rather free (due to its flexibility) in the center region 121. Therefore, the inclination 30 of the actuation part 14 leads also to an at least partial inclination of the membrane 12 so that the medium or liquid between the membrane 12 and the foil 18 is moved and thereby agitated. The at least partial inclination of the membrane 12 is indicated (only in FIG. 1) by small arrows 30' near the center 121 of the membrane 12 denoting the movement of the respective parts of the membrane 12 if an inclination following the arrow 30 is applied to the actuation part 14.

Figure 3:
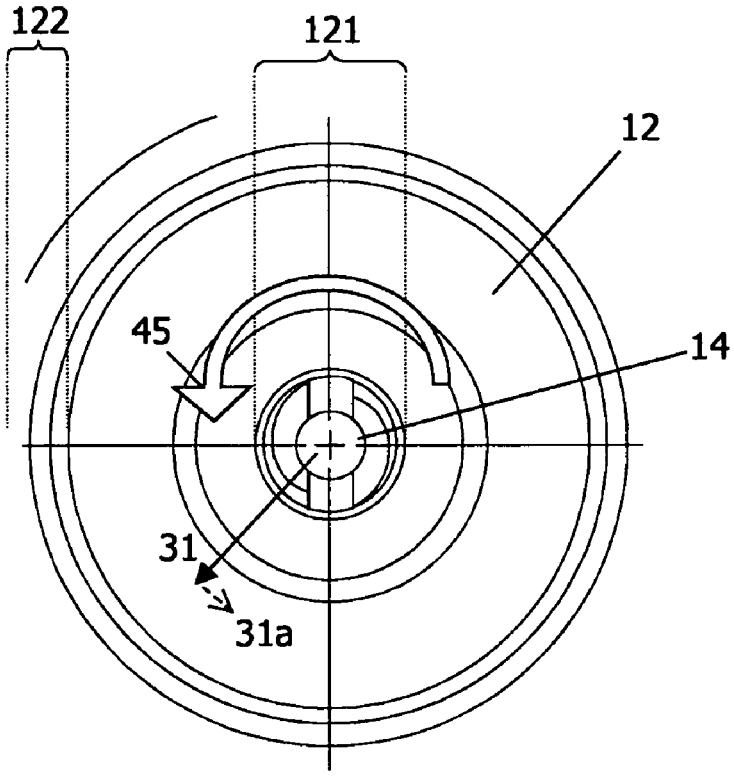
FIG. 3 illustrates schematically a top view of the membrane of an inventive device.

In FIG. 3 a top view of the membrane 12 of the inventive device 10 is schematically shown. The actuation part 14 can be moved along a first inclination movement 31 to a predefined inclination. By moving the actuation part 14 in the rotational direction 45 along with a second inclination movement 31*a*, another inclination position of the actuation part 14 can be reached (by maintaining the same degree of inclination of the membrane 12 but in another direction). By moving the actuation part 14 along a circle concentric with the membrane, it is thereby possible to impart a continuous mixing movement on the fluid in the mixing chamber 20 thereby efficiently mixing the fluid or medium. In FIG. 3, the center region 121 and the edge region 122 of the membrane 12 are also shown.

Figure 4:
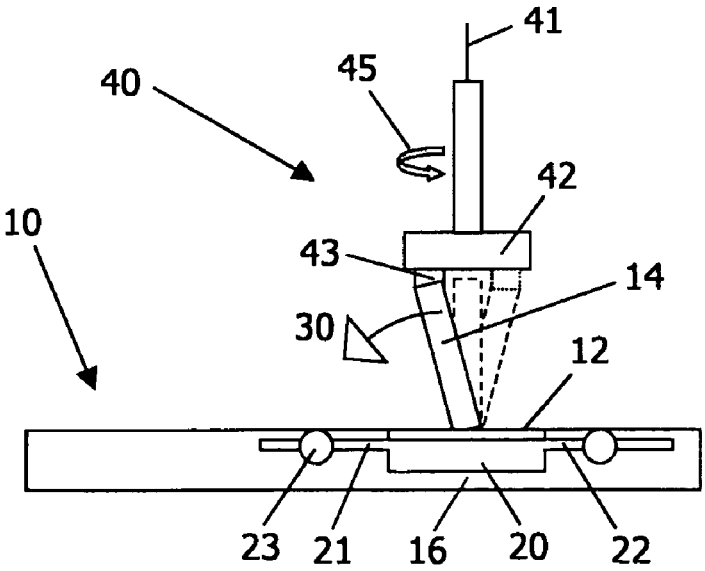
FIG. 4 illustrates schematically an apparatus together with a device according to the present invention.

In FIG. 4 an apparatus 40 according to the present invention is shown schematically together with the device 10. The apparatus 40 comprises a motor means (not shown), especially an electric motor, able to rotate an eccentric 42 about an axis of rotation 41 and according to a rotational direction 45. An adapter part 43 is able to interface with the actuation part 14 of the device 10, especially by means of a ball bearing. The advantage of a ball bearing is that there is no mechanical wear in the system and the lifetime will be long.

Other interfacing scenarios are also possible, e.g. by magnetic or electric forces. For example, electrostatic plates can be used to induce an electrical force on a charge or an iron, or other magnetic material in the actuation part 14 can be actuated by switchable magnets around it, or a piezoelectric actuation is also possible according to the present invention.

According to one preferred embodiment of the present invention, the amplitude of the eccentricity can be changed, i.e. the inclination 30 of the actuation part 14 can be changed by changing the eccentricity of the eccentric 42 of the apparatus 40. The amplitude of the eccentricity is limited by the elasticity of the membrane, which, in the context of the present invention, is also called flexible ceiling. A larger amplitude can be achieved by a larger diameter of the mixing chamber 20 and by a thinner membrane 20.

There is a relationship between the amplitude and the height of the fluid 19 underneath the membrane 12. A totally free hanging foil 18 according to the second embodiment as shown in FIG. 2 is less preferred according to the present invention.

The speed of rotation about the axis of rotation 41 is preferably in the range of approximately 1 to 100 rotations per second, especially preferred in the range of approximately 10 to 70 rotations per second, still more preferred in the range of approximately 20 to 50 rotations per second and most preferred in the range of approximately 34 to 45 rotations per second.

The eccentric 42 imposes an inclination 30 on the actuation part 14 of the device. By a rotation of the eccentric and thereby of the adapter part 43 about the axis of rotation 41, the liquid inside the mixing chamber 20 of the device 10 is mixed. In FIG. 4, three different positions of the actuation part 14 are indicated (one in solid lines and the others in dashed lines).

In the mixing device 10, an inlet 21 and an outlet 22 to or from the mixing chamber 20 are shown. Furthermore, a valve 23 is indicated by reference sign 23. For the sake of simplicity, FIG. 4 does not show an at least partial inclination of the membrane 12 due to the inclination 30 of the actuation part 14.

The invention claimed is:

1. A device for mixing a liquid medium, the device comprising:

a flexible membrane connected to a structural part;

an actuation part located on a first side of the membrane;

a foil connected to the structural part and located on a second side of the membrane; and a mixing chamber located between the membrane and the foil, wherein at least a partial inclination of the membrane results from an inclination of the actuation part relative to the structural part.

2. The device according to claim 1, wherein the foil is a flexible foil.

3. The device according to claim 1, wherein the foil is provided such that a movement of the foil in a direction perpendicular to the membrane is at least partly prevented by the structural part when the mixing chamber is filled with the medium.

4. The device according to claim 3, wherein the movement of the foil is at least partly prevented in a center region opposite a center part of the membrane.

5. The device according to claim 1, wherein the foil is provided such that a movement of the foil in a direction perpendicular to the membrane is not restricted by the structural part in a center region of the foil opposite a center part of the membrane when the mixing chamber is filled with the medium.

6. The device according to claim 1, wherein a height of the medium in the mixing chamber, perpendicular to the membrane, is defined by the structural part.

7. The device according to claim 1, wherein a height of the medium in the mixing chamber, perpendicular to the membrane, is defined by the foil.

8. The device according to claim 1, wherein the membrane and the structural part are connected in an edge region of the membrane.

9. The device according to claim 1, wherein the actuation part is provided in a center part of the membrane.

10. A device for mixing a medium comprising at least one fluid, the device comprising:

a membrane connected to a structural part;

an actuation part located on a first side of the membrane and configured to incline relative to the structural part, imparting an at least partial inclination of the membrane; and a flexible foil connected to at least one of the membrane and the structural part, the membrane and the flexible foil forming a mixing chamber between a second side of the membrane and the flexible foil for containing the medium, wherein the at least partial inclination of the membrane moves the medium in the mixing chamber.

11. The device according to claim 10, wherein the membrane and the structural part are connected in an edge region of the membrane.

12. The device according to claim 10, wherein the actuation part is provided in a center part of the membrane.

13. An apparatus for mixing a liquid medium provided in a mixing chamber, the apparatus comprising actuation means provided to impose an inclination movement on the actuation part of the device according to claim 10.

14. The apparatus according to claim 13, wherein the actuation means comprises an adapter part capable of imposing the inclination movement on the actuation part.

15. The apparatus according to claim 14, wherein the actuation means further comprises an eccentric and wherein the adapter part describes a rotational movement.

16. The device according to claim 10, wherein the membrane and the actuation part are provided as a one-piece part comprising a pressure die-cast part.

17. The device according to claim 10, wherein the membrane and the actuation part are provided as a one-piece part comprising an elastic deformable material.

18. The device according to claim 17, wherein the elastic deformable material comprises polypropylene.

19. The device of claim 10, wherein the flexible foil comprises a web or film material.

20. A system for mixing a liquid medium, the system comprising:

a flexible membrane connected to a structural part;

an actuation part located on a first side of the membrane;

a foil connected to the structural part and located on a second side of the membrane;

a mixing chamber located between the membrane and the foil, wherein at least a partial inclination of the membrane results from an inclination of the actuation part relative to the structural part; and actuation means configured to impose an inclination movement on the actuation part.

* * * * *